US005239843A

United States Patent [19]

Plath et al.

[11] Patent Number: 5,239,843

[45] Date of Patent: Aug. 31, 1993

[54] KNITTING MACHINE FOR THE PRODUCTION OF PLUSH GOODS

[75] Inventors: Ernst-Dieter Plath, Albstadt; Paul Neher, Messstetten; Gero Schindler, Albstadt-Margrethausen, all, of Fed. Rep. of Germany

[73] Assignee: Sipra Patententwicklungs- und Beteiligungsgesellschaft mbH, Albstadt, Fed. Rep. of Germany

[21] Appl. No.: 775,717

[22] Filed: Oct. 11, 1991

[30] Foreign Application Priority Data

Oct. 24, 1990 [DE] Fed. Rep. of Germany ..... 4033735

[51] Int. Cl.[5] ..... D04B 9/04

[52] U.S. Cl. ..... 66/92; 66/104

[58] Field of Search ..... 66/91, 92, 93, 104

[56] References Cited

U.S. PATENT DOCUMENTS 4,665,718 5/1987 Jelinek et al. ..... 66/93 X
4,862,709 9/1989 Engelfried et al. ..... 66/104

FOREIGN PATENT DOCUMENTS 0295703 6/1988 European Pat. Off. .
0335618 3/1989 European Pat. Off. .
1230958 6/1967 Fed. Rep. of Germany .
3145307 5/1984 Fed. Rep. of Germany .
3909816 9/1990 Fed. Rep. of Germany .
2038376 7/1980 United Kingdom ..... 66/92

*Primary Examiner*—Clifford D. Crowder
*Assistant Examiner*—John J. Calvert
*Attorney, Agent, or Firm*—Michael J. Striker

[57] ABSTRACT

For the production of plush knitted goods containing stitches made from main and plush threads, main threads and plush threads are fed to hooks and sinkers, at least the plush threads are pre-formed to plush thread loops by drawing back the knitting tools from a plush thread receiving position into an intermediate position and by, in so doing, drawing and holding taut the plush threads over associated ones of the sinkers, then stitches are formed with the main threads and plush thread loops by drawing back the knitting tools farther into a knocking-over position and by, in doing so, controlling the sinkers in such a way that the pre-formed plush thread loops are held in taut during the stitch formation and that the risk of shortening or undoing of pre-formed plush thread loops during such stitch formation is greatly diminished.

14 Claims, 8 Drawing Sheets

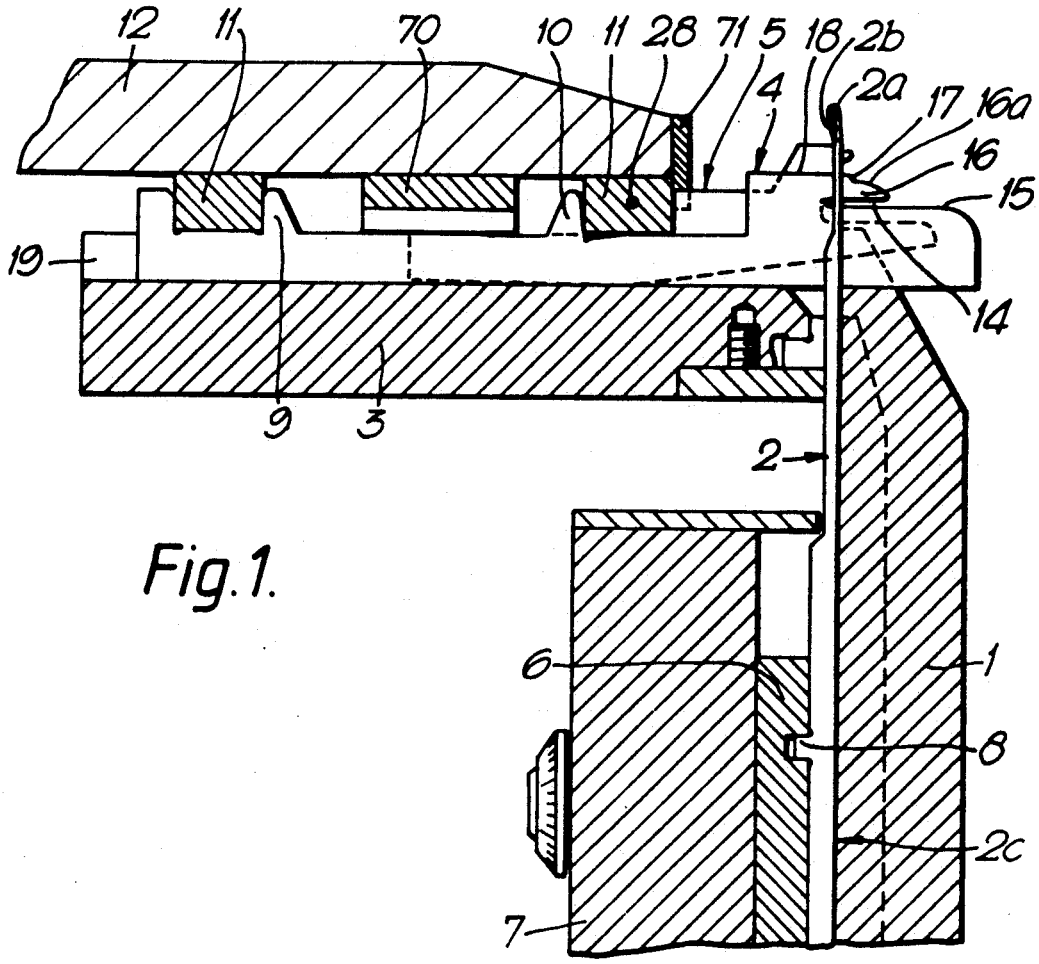
Fig. 1.
Fig. 2.
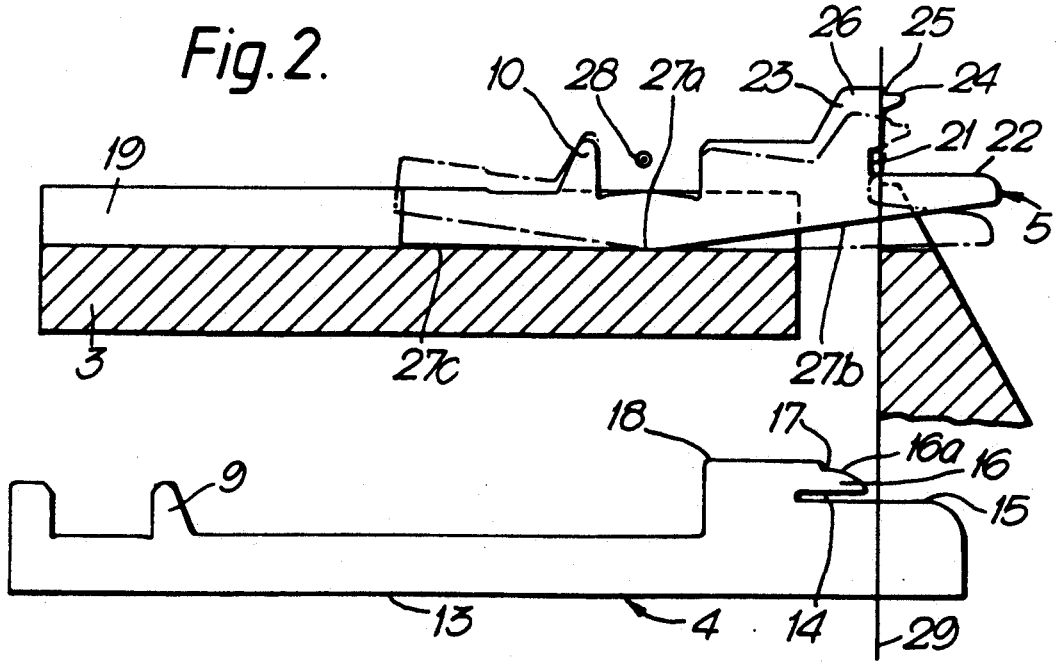

KNITTING MACHINE FOR THE PRODUCTION OF PLUSH GOODS

The invention is directed to a method for the production of plush goods containing main and plush thread stitches on a circular knitting machine comprising knitting tools with hooks and sinkers assigned to these knitting tools, main threads and plush threads being fed to these sinkers in order to form main and plush thread stitches, wherein at least the plush thread stitches are formed in that the plush threads are first inserted into the hooks of the knitting tools, pre-formed to form plush thread loops by means of the drawing back of the knitting tools from a thread receiving position into an intermediate position and by means of sinkers and, in so doing, the plush threads are held taut by the sinkers, and wherein the knitting tools are then drawn back farther into a knocking-over position. The invention is also directed to a knitting machine adapted to carry out such a method.

In knitting machines, particularly circular knitting machines of this type (DE-OS 31 45 307), and methods which can be carried out on the latter, the plush threads are floated behind those needles not selected for receiving plush threads. The length of the float depends on the number of successive needles not receiving a determined plush thread.

A particular problem in such knitting machines consists in that the main or ground thread loops and plush thread loops, which are preformed by means of sinkers, are always completely released by the sinkers for technical reasons relating to knitting when the needles move along the path from an intermediate position to their lowest position, i.e. into the knocking-over position, for the purpose of looping. If at this time there is only a floating plush thread portion arranged between the respective released plush thread loop and the respective plush thread guide and if, at the same time, a needle for receiving plush thread is selected at the respective plush thread guide and then drawn back into the intermediate position in order to pre-form another plush thread loop, then this needle can draw off the required amount of thread either from the supply coil assigned to the plush thread guide or, via the floating thread portion, from the plush thread loop which has already been formed beforehand, but which is now released and not controlled by the sinkers and has just passed through the cam portion completing the looping. Accordingly, there is a risk that the pre-formed plush thread loops will be shortened again subsequently or even completely pulled back, which must be avoided. This is particularly true if the plush thread fed to the plush thread guide is to be supplied at a certain minimum tension.

Corresponding circumstances can also occur when using other techniques for producing plush goods when a thread portion serving to form a new plush thread loop is connected with the last plush thread loop, formed beforehand, only via a float and this last plush thread loop is held neither by the needles nor by the sinkers and is therefore not ensured against subsequent shortening. This circumstance can also occur e.g. when the two cam portions belong to successive knitting systems and the sinkers are withdrawn from the second cam portion in order to enable the insertion of the main thread.

In order to prevent the subsequent shortening of plush thread loops which are already pre-formed it is known (DE-PS 12 30 958) in knitting machines for the production of plain or unpatterned plush goods to hold and secure the pre-formed plush thread loops between additional clamping elements. However, such devices can only be provided in knitting machines in which the plush thread loops are lengthened with special movable elements instead of by drawing the plush threads engaged by the needles through the needles themselves along the working surfaces of sinkers. Aside from this, the known method would not be suitable for knitting machines serving to produce patterned plush goods and in which shortening of such plush thread loops must be prevented which are followed by floating thread portions having a very particular length.

In another known circular knitting machine (CPA2-0295 703), the described problem is avoided to a great extent in that the main thread loops are not pre-formed. For this purpose, it is necessary to guide the main thread along as a straight thread piece within the slots of conventional holding-down sinkers from the location where it is inserted into the knitting needles by means of the main thread guide up to the place where the main thread stitches are knocked over together with the plush thread stitches. Therefore there is a risk, particularly in multi-colored patterns, that the main thread piece, which is very long under certain circumstances, will tear. Aside from this, it can not be entirely ruled out that plush thread loops which are already pre-formed will be shortened also in this known circular knitting machine or with the methods which can be carried out on the latter, since these plush thread loops are at least partially abruptly transferred from a high sinker to edge to a low sinker edge prior to the knocking over of the stitches and therefore lie relatively loosely on the low sinker edges until the knitting needles have reached the knocking-over position, and can therefore be shortened again by means or via a floating.

Further, it is known to prevent the problem discussed above by means of special thread wheels (DE-OS 39 09 816). However, this method is comparatively complicated and involves costly additional devices.

Finally, if the main thread loops are not formed beforehand and the pre-formed plush thread loops are not transferred to a lower sinker edge prior to knocking over (EP-A1-0335 618), there is a risk that both the main thread loops and the plush thread loops will tear when the knitting tools are drawn back from the intermediate position into the knocking-over position.

It is, therefore, an object of this invention to develop the method mentioned above in such a way, that the risk of shortening or undoing the plush thread loops is greatly diminished even when the thread portions extending from them until the respective plush thread guide float along their entire length.

A further object of this invention is to develop the method mentioned above also in such a way that there is no risk of breakage for either the ground threads or the plush threads.

Yet another object of this invention is the design of a knitting machine on which such methods can be easily carried out.

Those and other objects of this invention are solved by a method for the production of plush goods containing main and plush thread stitches on a circular knitting machine having knitting tools with hooks and sinkers assigned to these knitting tools, comprising the steps of feeding main threads and plush threads to the sinkers in order to form main and/or plush thread stitches, forming at least the stitches containing at least a plush thread in that the plush threads are inserted into the hooks of knitting tools and then pre-formed to form plush thread loops by means of sinkers, by means of drawing back the knitting tools from a thread receiving position into an intermediate position, and by, in so doing, holding taut the plush threads by means of the sinkers, and, if desired after having received at least a ground thread, drawing back the knitting tools farther into a knocking-over position and controlling the sinkers in such a way that the pre-formed plush thread loops are also controlled and held taut during the continued drawing back of the knitting tools.

A knitting machine for the production of plush knitted goods containing stitches being made from main and/or plush threads comprises in accordance with this invention a needle carrier in which knitting tools intended for the formation of the main and plush thread stitches are movably supported, a sinker carrier in which sinkers for controlling the looping are movably supported, at least one main thread guide for feeding the main thread, at least one plush thread guide intended for feeding the plush thread, and a cam arrangement for controlling the knitting tools and sinkers. At least the stitches containing at least a plush thread can be produced in that knitting tools after receiving the plush thread are drawn back into an intermediate position for the purpose of pre-forming the plush thread loops by means of the sinkers and, if desired after having received at least a ground thread, are drawn back farther through a non-knitting position into a knocking-over position for the formation of the stitches containing at least a plush thread. The cam arrangement comprises means for controlling the sinkers in such a way that the plush threads are controlled and held taut during the pre-forming as well as during the continued drawing back of the knitting tools.

The novel features which are considered as characteristic for the invention are set forth in particular in the appended claims. The invention itself, however, both as to its construction and its method of operation, together with additional objects and advantages thereof, will be best understood from the following description of specific embodiments when read in connection wit the accompanying drawing.

The invention is explained in more detail in the following with the attached drawing with reference to a circular knitting machine as an embodiment example.

FIG. 1 shows a schematic longitudinal section through a circular knitting machine, according to the invention, for the production of patterned plush goods;

FIG. 2 is a schematic view of the arrangement and support of sinkers inside the circular knitting machine according to FIG. 1;

Figure 3:
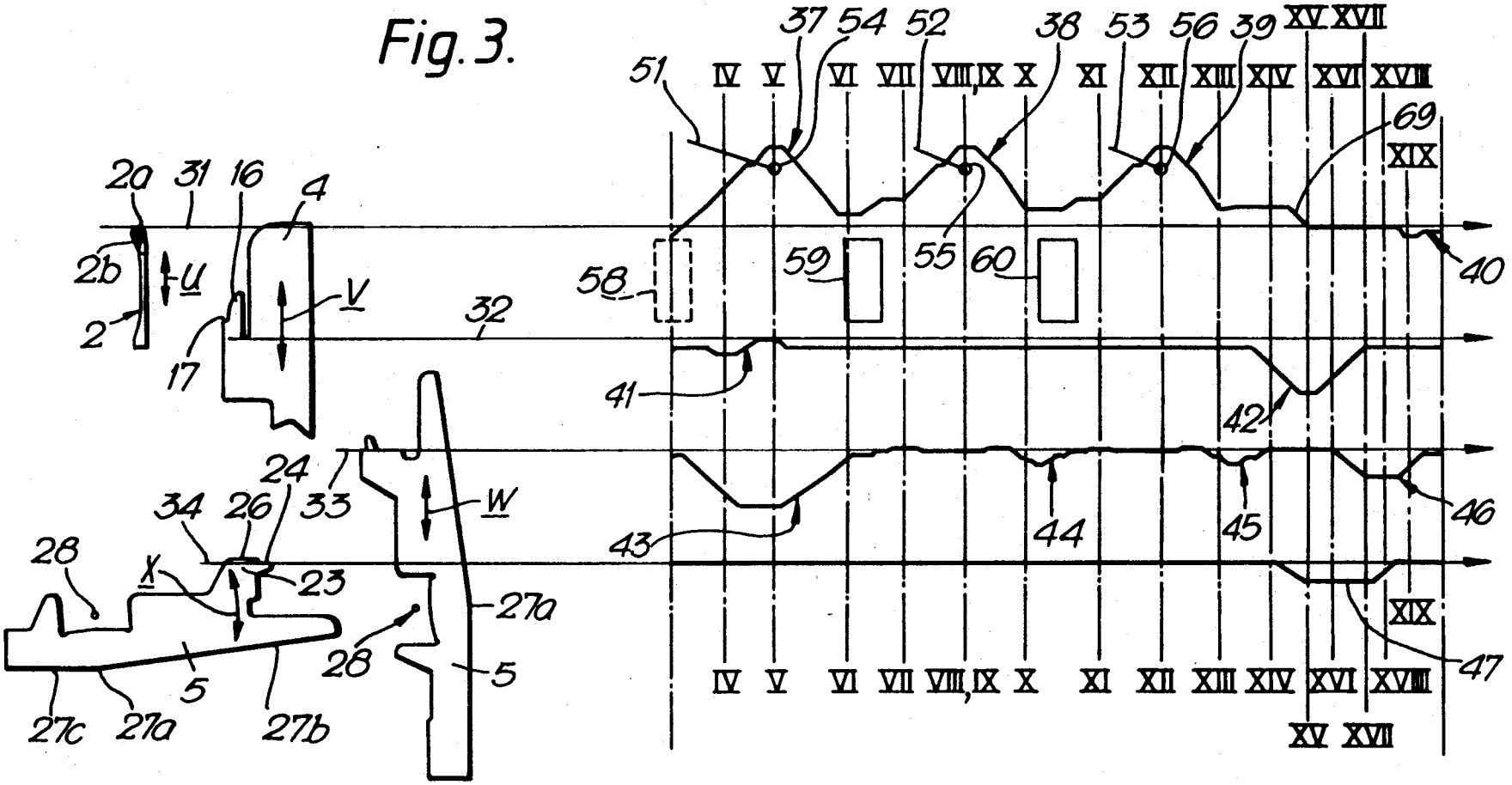
FIG. 3 shows a schematic developed top view of a cam arrangement of the circular knitting machine according to FIG. 1.
Figure 4:
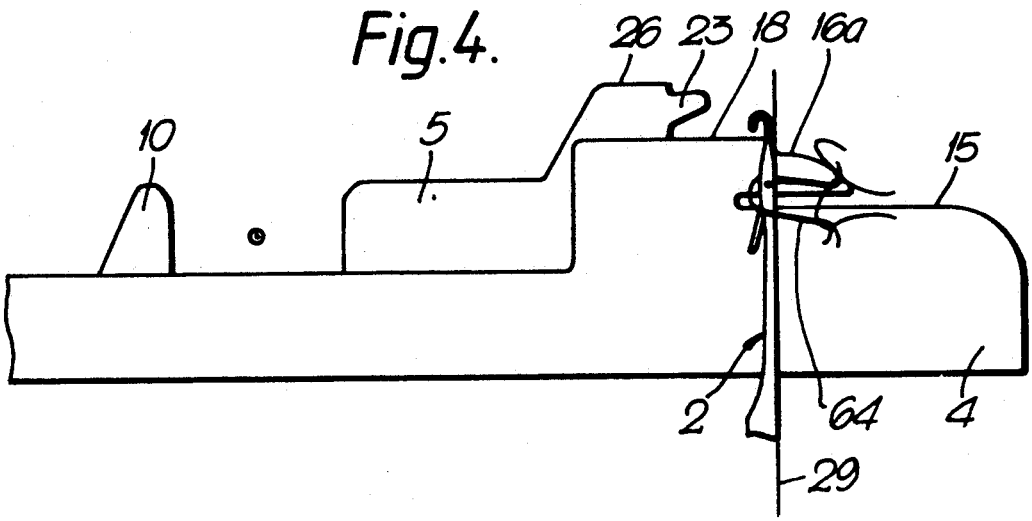
FIG. 4 to 19 show the relative positions of the knitting tools and sinkers during the knitting process at the locations in FIG. 3 designated by IV—IV to XIX—XIX.
Figure 5:
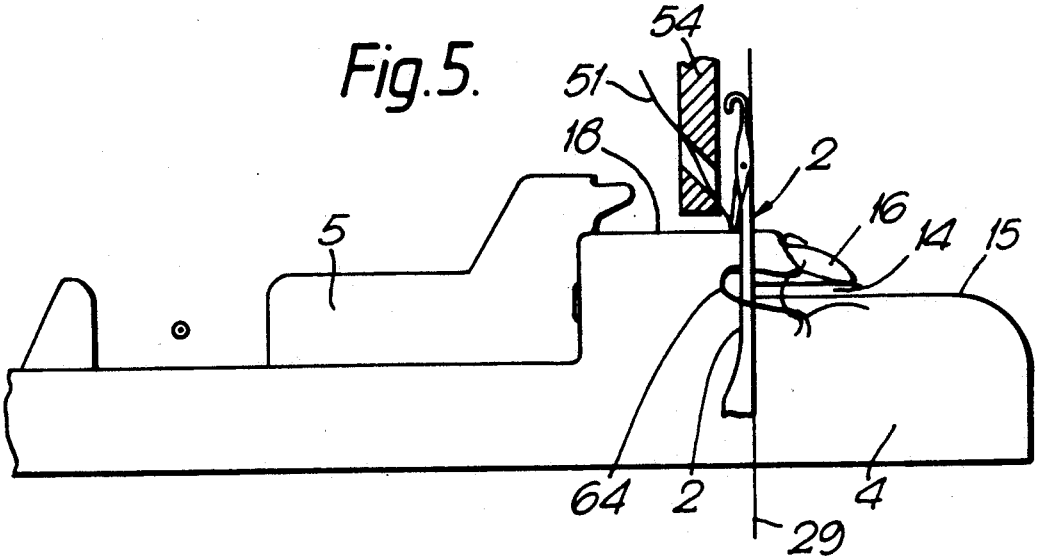

FIG. 1 shows an embodiment form of the invention with reference to the example of a multiple-system circular knitting machine for the production of patterned plush knitting goods. This circular knitting machine is known in principle (DE-OS 31 45 307) with the exception of the sinkers, according to the invention, so that only parts substantial to the present invention are discussed in more detail in the following.

The circular knitting machine comprises a knitting tool carrier 1 in the form of a rotatably supported needle cylinder in which knitting tools, particularly conventional latch needles 2 with hooks **2*a* and latches 2*b*, are supported so as to be movable, and a sinker carrier 3 in the form of a sinker disk or ring which is rotatable with the needle cylinder 1 and in which sinkers 4 and 5 are supported so as to be movable. The two sinkers 4 and 5 are arranged in pairs in slots of the sinker carrier 3 and one such pair is assigned to every needle 2. The needles comprise a butt 8 controlled by cam parts 6 of a needle cam 7, the sinkers 4 and 5 each comprise a butt 9 and 10, respectively, which are controlled by cam parts 11 of a sinker cam 12. The needle and sinker cams 7 and 12, respectively, are component parts of a cam arrangement, wherein the needles 2 and the needle cam 7 serve substantially to form main or ground stitches and plush thread stitches, and the sinkers 4 and 5 and the sinker cam 12** serve substantially to control the main or ground and plush thread loops when formed.

The sinkers 4 are constructed in a known manner as holding-down and knocking-over sinkers. For this purpose, they comprises in each instance, at their front ends and above their bottom edges 13, a lower edge 15 which passes into a longitudinal slot 14 and a protuberance 16 located above same, the lower side of the protuberance 16 defines the longitudinal slot 14 and the protuberance or nose 16 located with an upper edge **16*a* whose rear end is connected via a shoulder 17 with an edge 18 which is situated even farther back and above the protuberance 16. The edges 18 and 15 extend substantially parallel to the bottom edge 13, while the edge 16*a* slopes downward slightly, so that its distance from the edge 15 gradually decreases from a place situated immediately before the shoulder 17 to a tip formed at the front end of the protuberance. Moreover, the protuberance 16, as measured from the base of the slot 14, is shorter than the edge 15**.

The sinkers 4 and 5 are arranged in pairs in grooves or channels of the sinker carrier 3, wherein these grooves are formed by means of webs 19 indicated in FIG. 2. The sinker 4, which is actually arranged adjacent to the sinker 5, is shown below the latter in FIG. 2 in order to show the geometry of the sinker 5 in a clearer fashion. As shown particularly by FIG. 2, the sinker 5 is provided at its front side with a recess 21 whose lower side is formed in part by an edge 22 extending up to the front end of the sinker 5 and whose upper side is formed by the underside of a protuberance or nose 23 situated above the edge 22, but is shorter than the edge 22 as measured from the base of the recess 21. The protuberance 23 comprises, on its upper side, an edge 24 which extends up to its front end, the rear end of the edge 24 passes, via a shoulder 25, into a somewhat higher edge 26 which is situated still farther back. Moreover, the sinker 5 comprises a lower edge which is formed from two legs **27*b* and 27*c* which coincide at a middle tip 27*a* at an obtuse angle. Therefore, when the sinkers 5 lie, e.g. with their legs 27*c*, on the bass of the grooves of the sinker carrier 3 formed by the webs 19, as is indicated by a solid lien in FIG. 2, they can be swiveled in the clockwise direction around their tips 27*a* into a position in which they lie on the groove bases with their legs 27*b*, as is indicated in FIG. 2 by a dashed line. Conversely, a swiveling of the sinkers 5 in the counterclockwise direction from the position shown by a dashed line into the position shown by a solid line is naturally also possible. The swivel axis is arranged vertically with respect to the webs 19. Since the tip 27***a* of the sinkers 5 is covered by the other sinker 4 in FIGS. 1 and 4–19, its exact position in a direction parallel to the webs 19 is shown in the drawing by a point 28 surrounded by a small circle. Moreover, the plane in which the back 2*c* (FIG. 1) of the needle 2 in question in the particular case or the base of the respective groove in the knitting tool carrier 1, respectively, is located is indicated in FIGS. 2 and 4–19 by means of a vertical line 29. For the rest, the edges 22, 24 and 26 of the sinkers 5 extend substantially parallel to or at a distance from the respective leg 27*b* situated in front, which distance decreases slightly toward the front.

The edges 24, 26 of the sinker 5 are situated above the upper top edge 18 of the sinker 4 when the legs 27*c* of this sinker 5 lie on the groove base. On the other hand, if the leg 27*b* of the sinker 5 lies on the groove base, the edge 24 is located at substantially the same height as the edge 16*a* of the sinker 4 at its highest point.

FIG. 3 is a schematic view of a portion of the cam arrangement of the circular knitting machine suitable for knitting a two-color plush fabric. Line 31 shows the position occupied by the hooks 2*a*of the needles 2 when the latter are located in their circular running or non-knitting position. Line 32 shows the position in which the sinker 4 is arranged in its position which is the farthest advanced in the direction of the needles 2, i.e. in the position farthest to the right in FIG. 1. A line 33 indicates the farthest advanced position of the sinkers 5 in a corresponding manner. Lines 32 and 33 substantially correspond to line 29 in FIGS. 2 and 4–19, so that a downward displacement of the sinkers 4 and 5 in FIG. 3 corresponds to a radial withdrawal from line 29 to the lefthand side and an upward displacement of the sinkers 4 and 5 corresponds to a radial advance in the direction of the needles 2. Finally, a line 34 indicates the highest position of the edges 24 of the protuberances 23, wherein this corresponds to that position of the sinkers 5 in which their legs 27*c* lie on the groove base. Therefore, the edges 24 in FIG. 3 can only move downward parallel to the needle movement from this position. For the rest, the possible movements of the needles 2 and sinkers 4 and 5 are indicated in FIG. 3 by arrows u, v, w and x.

The paths on which the needles 2 and the sinkers 4, 5 can be guided during the knitting process are indicated in FIG. 3 by lines 31 to 34 and path portions 37 to 47 diverging from the latter. All of these path portions 37 to 47 are realized in a manner known per se by means of cam parts or the like which act on the buts 8, 9 and 10 of the knitting tools 2 and sinkers 4 and 5, respectively, and which were omitted in FIG. 3 for the purpose of simplicity.

Thread guides 54 to 56 are provided in a known manner for the purpose of feeding a main thread 51, a plush thread 52 with a first characteristic, e.g. color, and a plush thread 53 with a second characteristic, e.g. color. In order to select those needles 2 which will receive one of the threads 51 to 53, selecting devices 58, 59 and 60 which cooperate with correspondingly constructed cam parts are assigned, likewise in a known manner, to the needles 2 or to push rods assigned to the latter, or the like, prior to the ascending areas of the path portions 37, 38 and 39.

The production of a multiple-color plush knitted fabric with the use of the circular knitting machine discussed with reference to FIGS. 1 to 3 is effected in the following manner. The method steps discussed with reference to FIGS. 4 to 13 correspond to the known method steps (DE-PS 31 45 307) in spit of the use of different sinkers while the method steps according to FIGS. 14 to 19 are new and derived from the sinkers constructed in a different manner. For the rest, it is assumed that a circular knitting machine with rotatable needle cylinder 1 and stationary cam arrangement is used, although the opposite could also be true. The running direction of the needles 2 and the sinkers 4 and 5 can be seen from the heads of the arrows at the ends of lines 31 to 34.

Figure 6:
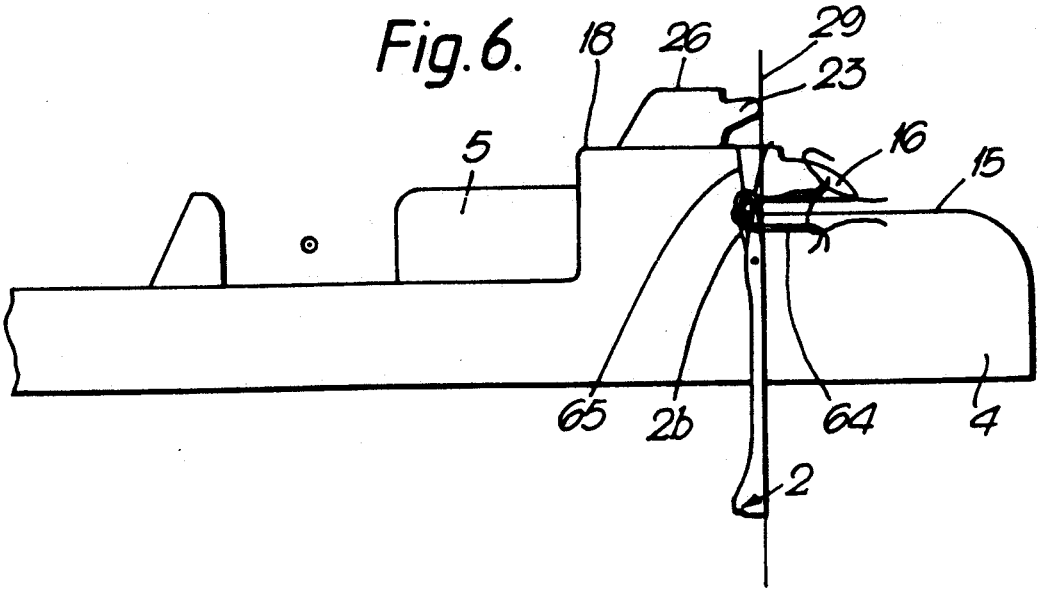
Figure 7:
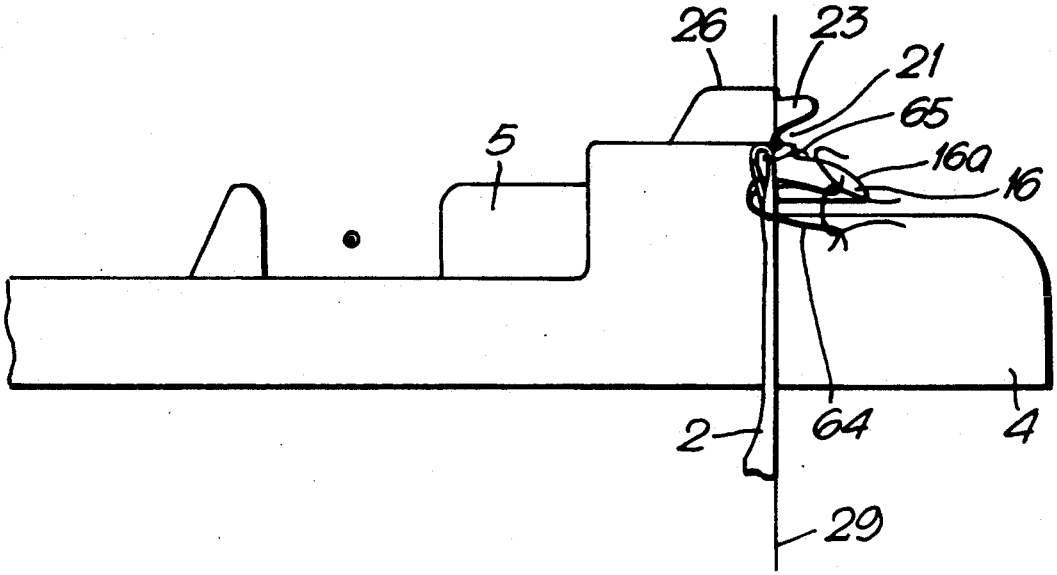

The cam arrangement—as seen in the knitting direction contains a first path portion 37 along which all the needles 2 are first moved out into their highest position (FIG. 5).The sinkers 5 are controlled along path portion 43 so as to move gradually into their completely drawn back position (FIG. 5) in order to make room for the main thread guide 54, while the sinkers 4 remain in the normal holding-down position for the time being (FIG. 4), but are then advanced somewhat farther (path portion 41, FIG. 3) in order to tighten, with their shoulders 17, the plush thread stitches which are formed in the preceding method step and located on their protuberances 16. All needles 2 then receive the main thread 51 (FIGS. 3, 5) which is fed by means of the main thread guide 54, while all previous stitches 64 arrive on the shanks of the needles 2 via the opening latches 2*b*. All needles 2 are then drawn back into an intermediate position (FIG. 6) which is higher than the non-knitting position (line 31), but is still located low enough to form main thread loops 65 and to pre-form or pre-sink the latter along the upper top edges 18 of the sinkers 4. In this process, the latches 2*b* of the needles 2 are closed again by the previous stitches 64. However, the previous stitches 64 are not yet knocked over (FIG. 6). The sinkers 5 are advanced again after the main thread guide 54 passes through path portion 43, while the sinkers 4 are guided back into the normal holding-down position. In the fully advanced position (FIG. 7) of the sinkers 5, the front edges formed by the bases of the recesses 21 serve moreover to tighten or maintain the tightness of the pre-formed or the pre-drawn main thread loops 65.

Figure 8:
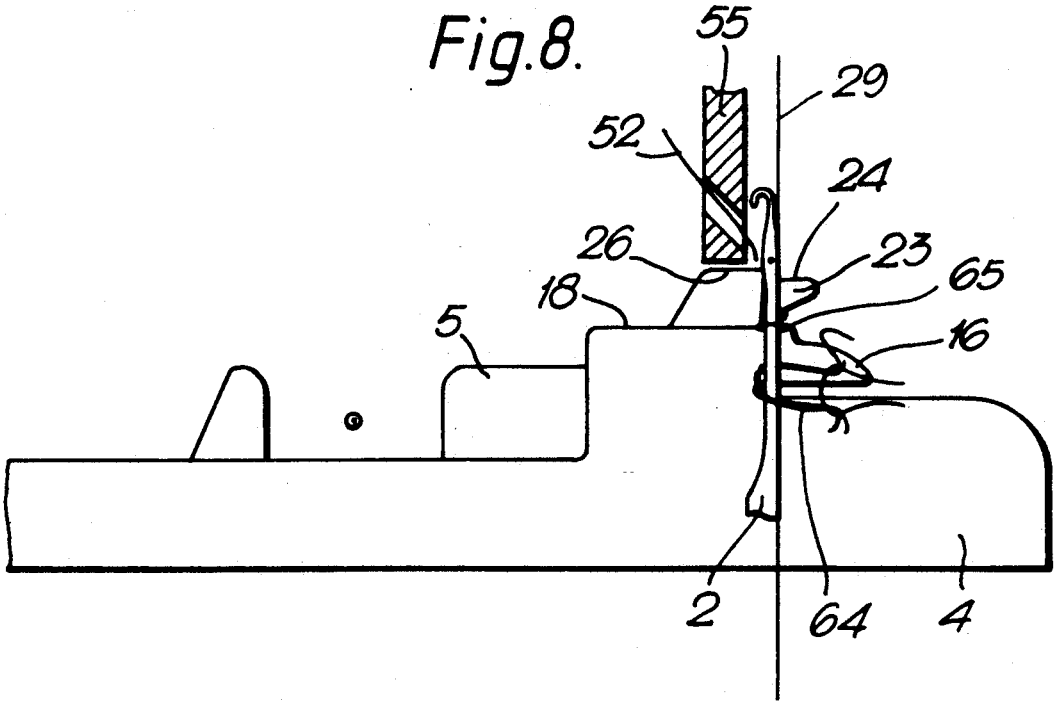
Figure 9:
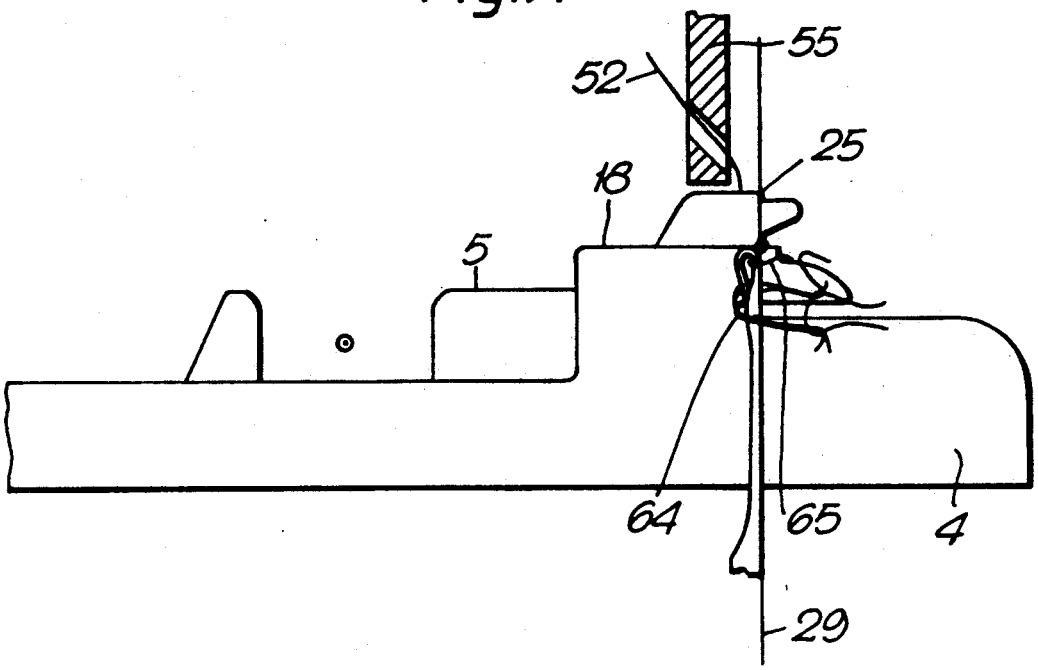
Figure 10:
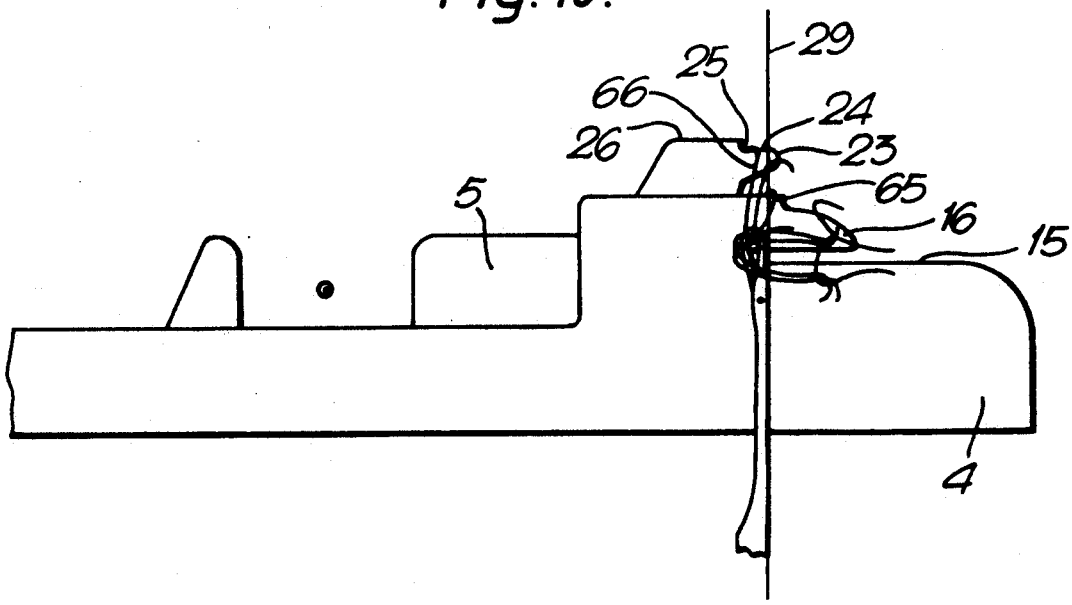

Before entering a second path portion 38, the selecting device 59 selects the needles 2 which are to receive the plush thread 52 presented by the plush thread guide 55 (FIGS. 3,8). The heads of these needles 2 are then lifted from path portion 38 for receiving the plush thread (FIGS. 3, 7 and 8) and are then drawn back again into the intermediate position (FIG. 10). In so doing, the plush thread 52 is first drawn over the upper edges 26 of the sinkers 5, since the plush thread guide 55 is not arranged close above the upper edges 18 of the sinkers 4, in contrast to the main thread guide 54, but above the upper edges 26 of the sinkers 5 (FIG. 8). In spite of this position of the plush thread guide 55, the main thread loops 65 formed beforehand can not slide under the ends of the opening needle latches when the needles move out into the position suitable for receiving the plush thread 52, since the highest position of the upper edges 26 of the sinkers 5 is far enough above the edges 18 of the sinkers 4 holding the main thread loops 65 that the ends of the opened needle latches remain below the edges 18 and the main thread loops 65 accordingly remain on the needle latches (tuck on the needle), but the open needle hooks can simultaneously be raised sufficiently far above the edges 26.

After the needles 2 are drawn back into the intermediate position again (FIG. 10), the sinkers 5 are temporarily drawn back by means of path portion 44 (FIG. 3), so that newly formed plush thread loops 66 slide from the upper edge 26 over the shoulder 25 to the slightly lower edge 24 of the protuberance 23 of the sinker 4 and relax (FIG. 10), so that the risk of thread breakage is reduced.

The sinkers 4 remain substantially in their holding down position during this method step, while the needles 2 which are not to receive the plush thread 52 remain in the intermediate position (FIG. 9), so that their hooks 2*a* are closed by the previous stitches 64 and held close under the upper edges 18 of the sinkers 4.

Figure 11:
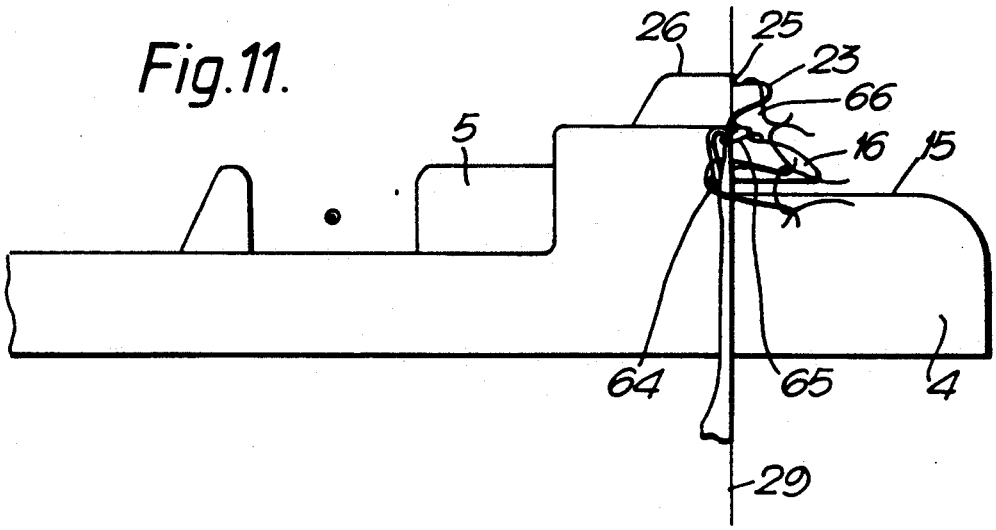
Figure 12:
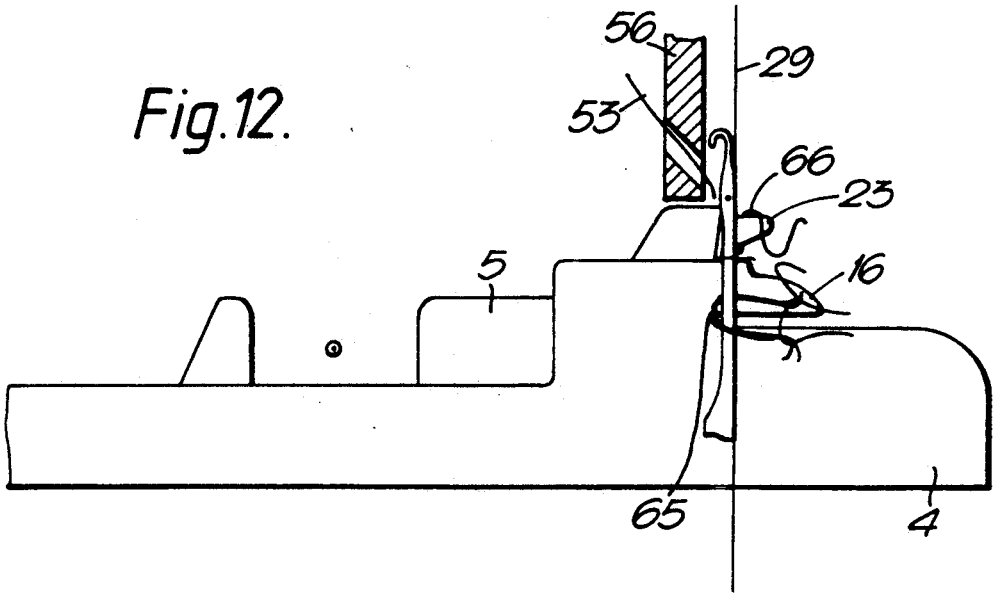
Figure 13:
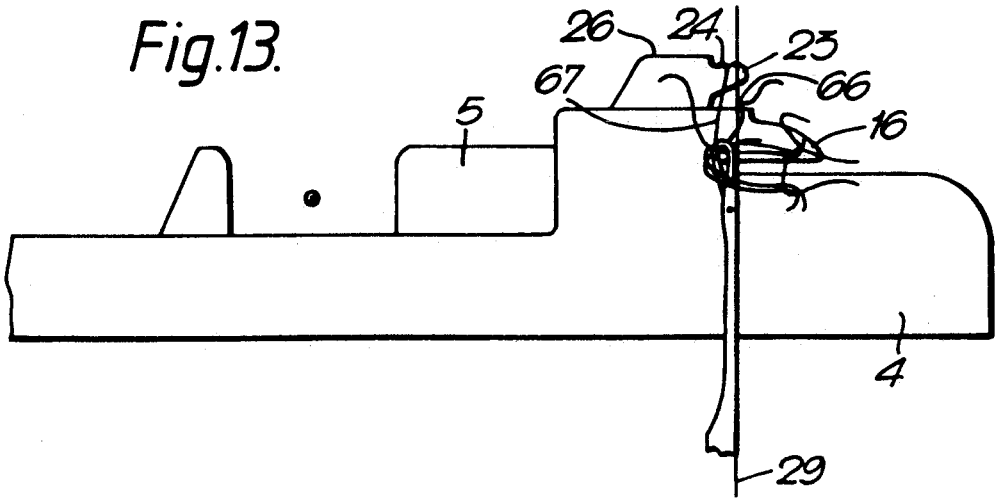
Figure 14:
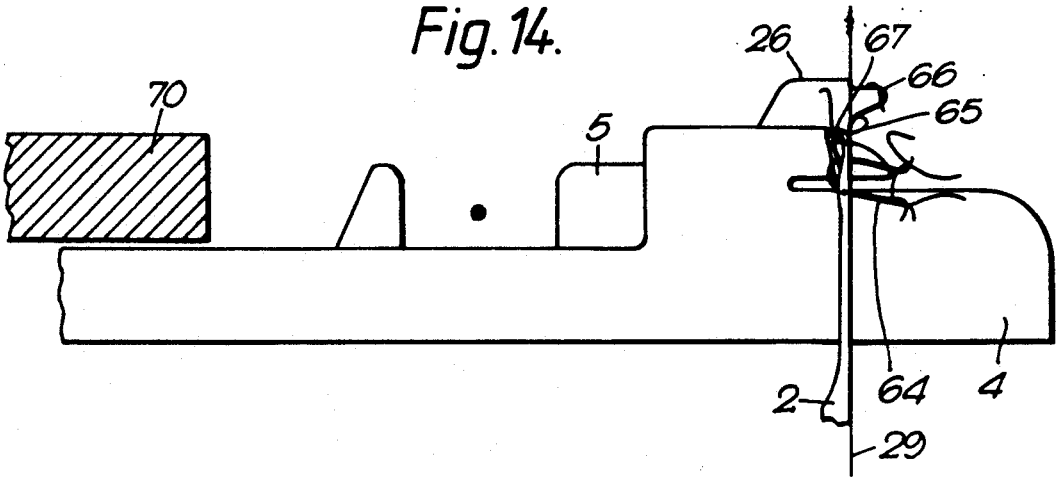

FIGS. 11 to 13 show the insertion of the second plush thread 53 in selected needles 2 ar locations XI—Xi to XIII—XIII corresponding to locations, VII—VII, VIII—VIII and X—X, wherein, as a rule, the needles 2 which have not received the first plush thread 52 receive the second plush thread 53, and vice versa. In order to prevent the selected needles from piercing the plush thread loops 66 which are already formed, the latter, which are located on the respective edges 26 of the sinkers 5, and the plush thread floats lying between the latter are slid behind the backs of the needles 2 by means of the shoulders 25 after the sinkers 5 are advanced again by means of path portion 44 (FIG. 11). After the needles 2 are moved out and drawn back for receiving the plush thread 53, the sinkers 5 are drawn back by means of path portion 45 in order to carry plush thread loops 67 formed with the plush thread 53 to the edges 24 of the protuberances 23 (FIG. 13), and are then moved forward again until they and the needles 2 again substantially occupy the position (FIG. 14) which can also be seen from FIG. 11.

Subsequently, other path portions corresponding to path portions 38, 39 and 44, 45, respectively, as well as plush thread guides and selecting devices assigned to the latter, can be provided so as to be able to feed plush threads having other characteristics, e.g. colors, if desired. In every case, the positions seen in FIGS. 11 to 14 for the individual functioning parts occur again at the end of such path portions, after which a main thread loop 65 and a selected plush thread loop 66 and 67, respectively, are located in the hooks 2*a* of the needles 2 and the main thread loops 65 lie on the edges of the protuberances 16, whereas the plush thread loops 66, 67 lie on the edges 24 of the protuberances 23.

The previous stitches 64 are now knocked over the pre-formed new main thread and plush thread loops 65, 66 and 67, respectively, in such a way that the latter remain constantly under the control of the sinkers 4 and 5, in that the latter are controlled so as to move from the intermediate position into the knocking-over position during the continued drawing back of the needles 2 in such a way that at least the pre-formed plush thread loops 66, 67 are held so as to be continuously tensioned. For this purpose, in the embodiment example, the main thread loops 65 are transferred to the lower edges 15 of the sinkers 4 and the plush thread loops 66, 67 are transferred to a level which corresponds to the height of the upper edge 16*a* of the protuberances 16 of the sinkers 4.

Figure 15:
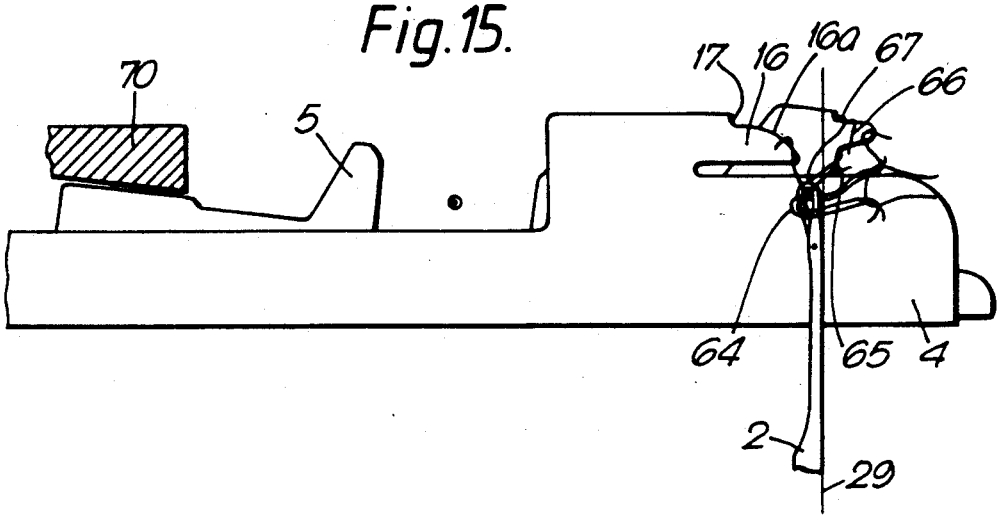
Figure 16:
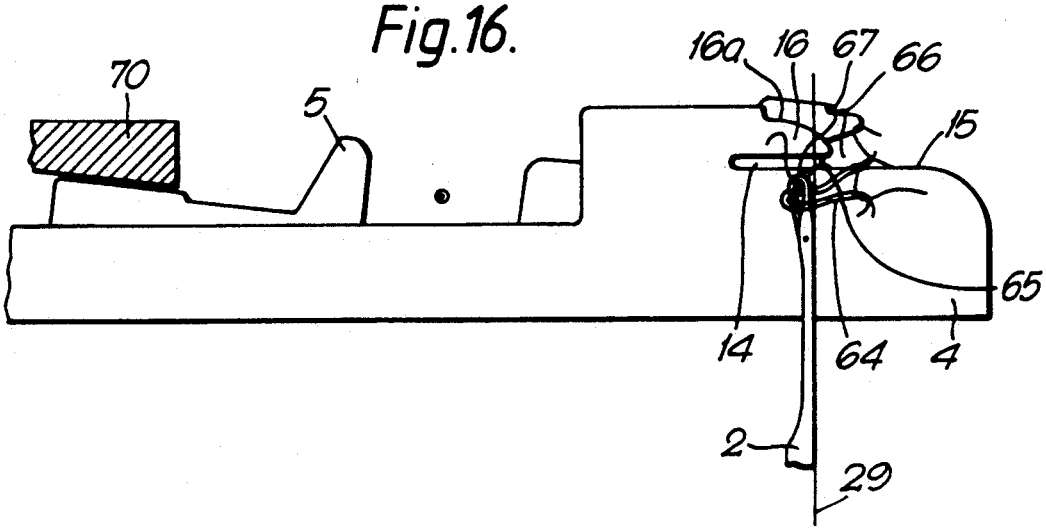
Figure 17:
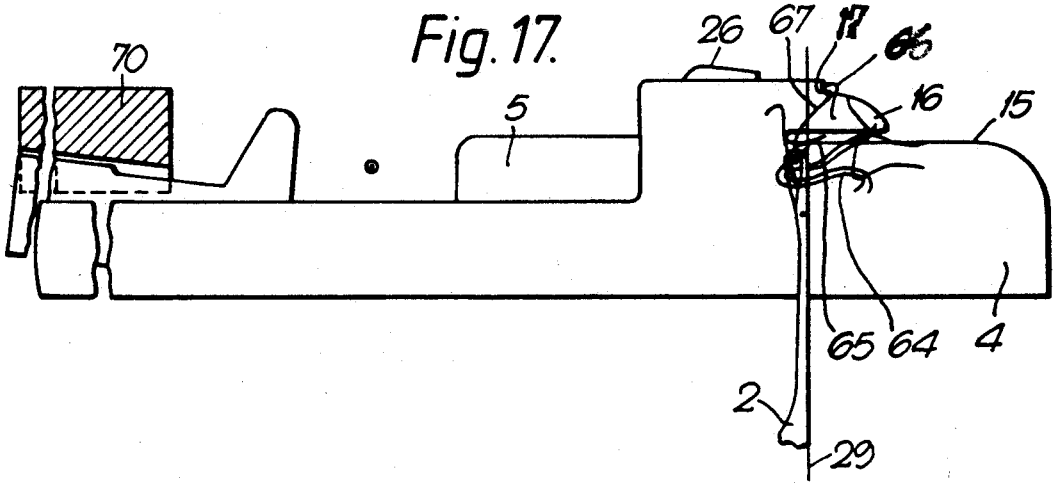
Figure 18:
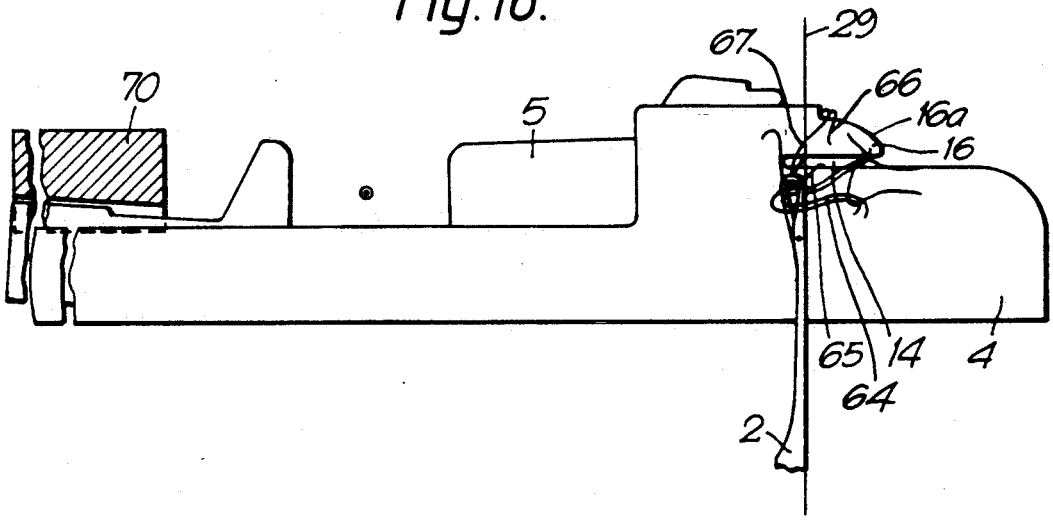
Figure 19:
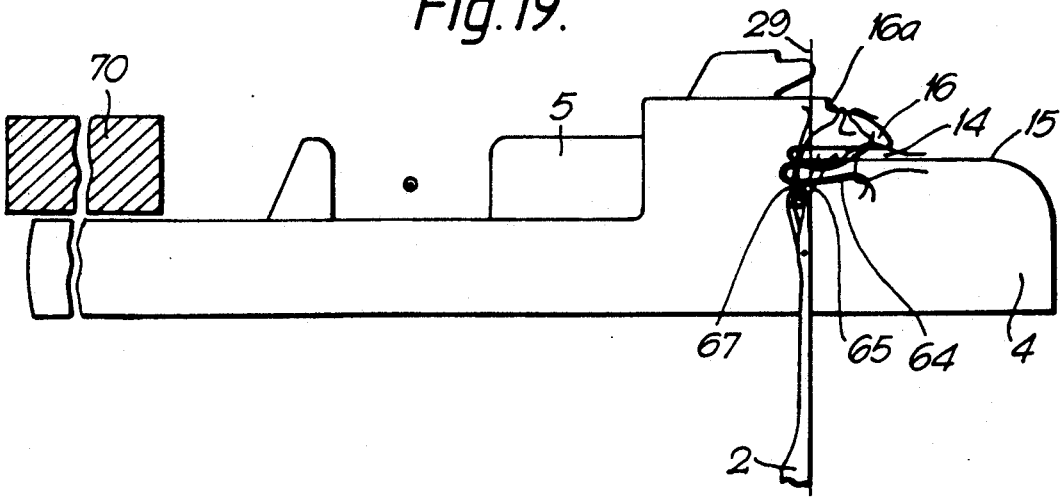

In order to transfer the main thread loops, the sinkers 4 are first drawn back by means of path portion 42 until the newly formed main thread loops 65 have been released by the shorter protuberances 16 (FIG. 15), and then advanced again so that the main thread loops 65 now lying on the edges 15 arrive in the slots 14 of the sinkers 4 (FIGS. 16, 17). The sinkers 5 keep the main thread loops 65 tight.

As shown by FIGS. 3 and 15, the needles 2 are drawn back out of the intermediate position into the circular running or non-knitting position simultaneously during the drawing back of the sinkers 4 by means of a path portion 69. As a result of the tensile forces exerted on the plush thread loops 66, 67, the sinkers 5 begin to swivel around their tips 27*a* until their legs 27*b* lie on the base of the sinker channels and their rear ends gradually move out of these channels. Since the upper edges 24 of the protuberances 23, in so doing, are swiveled down to the extend that the needles 2 are drawn against the shoulders 25, so that they can not slide from the sinkers 4. The swiveling process is terminated approximately at location XV—XV (FIG. 15). If the sinkers 4 are now advanced again (FIG. 16), the plush thread loops 66 and 67, respectively, are threaded on their protuberances 16 and tensioned or held taut, as required, by means of the shoulders 17.

At the same time, the sinkers 5 are drawn back along path portion 46. As a result, their protuberances 23 are drawn out of the plush thread loops 66, 67 and the latter are then only held by the upper edges 16*a* of the protuberances 16 of the sinkers 4(FIG. 17), while the main thread loops 65 are simultaneously arranged in the slots 14 of the sinkers 4. The needles 2 are now drawn back along path portion 40 into their lowest position (FIG. 19), wherein the plush thread loops 66, 67 lie on the upper edges 16*a* and the main thread loops 65 lie on the lower edges 15 of the sinkers 4 and are decisively formed out by the latter and drawn through the previous stitches 64 accompanied by the formation of new stitches. At the same time, the sinkers 5 are swiveled back again along path portion 47 in FIG. 3 by means of a cam part 70, which can be seen from FIGS. 18 and 19, and are moved forward (FIG. 19) by means of path portion 456, so that the initial situation immediately prior to location IV—IV results again and the formation of the next series of stitches can commence.

In unfavorable instances, particularly when there is insufficient friction of the sinkers 5 in the respective sinker bed channels, the swiveling ability of the sinkers 5 could have the undesirable effect that the protuberances 23 swivel down already in the portion of the cam arrangement situated in locations IV—IV and XIV—XIV, which would prevent a sufficient formation of the plush thread stitches 66,67. This can be prevented in a simple manner in that the cam part 70 is also arranged between locations IV—IV and XIV—XIV and is constructed in this place as a stop which impedes a swiveling movement of the sinkers 5 in the clockwise direction.

In a corresponding manner, the cam part 70 between locations XIV—XIV and XVI—XVI could be constructed in such a way that it allows the sinkers 5 to swivel only to an extent corresponding to the drawing back of the respective needles 2. The sinkers 5 are accordingly safely prevented from swiveling abruptly into the position according to FIG. 16 and the plush thread stitches from sliding in an undesirable manner from their protuberances 23.

Swiveling movements in the counterclockwise direction can be prevented or limited if necessary, e.g. by means of corresponding cam parts acting on the parts of the sinkers 5 comprising the legs 27*b*, as is indicated in FIG. 1 by cam part 71. Corresponding cam parts can serve to swivel the sinkers 5 in a controlled manner out of the position according to FIG. 14 into the position according to FIGS. 15 and 16.

If the construction of the described circular knitting machine is selected in such a way that the distances of the hooks 2a from the edges 18, 26 of the sinkers 4 and 5 when the needles 2 are in the intermediate position (e.g. FIGS. 6, 10, 13) substantially correspond to the distances of the hooks 2a from the edges 15, 16a when the needles 2 are in the knocking-over position (FIG. 19), then it is ensured in a simple manner that no additional thread pieces need be drawn off from adjacent loops or from the supply coils at all during the knocking over of the stitches 64. The risk of tearing threads is therefore minimal. Moreover, it is ensured that loops which are already formed beforehand are controlled and held taut by the sinkers also during the knocking over of the stitches. Finally, a pre-sinking of the main threads is also made possible in a simple manner.

The invention is not limited to the described embodiment example, which can be modified in a simple manner. For example, it is possible to combine path portions 37 and 40 to form a knocking-over and main thread system, to assign path portions 38 and 39 to a plush thread system and to arrange the cam parts of all of these systems at a common cam segment. These cam segments could be provided with the cam parts of three, four, five or more systems depending on the number of plush threads included and could be mounted and dismounted as a whole. It would also be possible to provide at least one additional main thread system prior to or subsequent to the main thread system containing path portions 37, 41 and 43 and to assign the selecting device 58 indicated in dashed lines in FIG. 3 to one of the two main thread systems. This would then make it possible to provide basic fabric patterns of two or more threads in order thereby to influence the stability of the basic fabric. Further, it would also be possible to transfer the plush thread loops from the sinkers 5 to the sinkers 4 in a manner other than by means of a swiveling movement, e.g. by means of sinkers which comprise bent protuberances similar to the protuberances 16 and which are drawn back radially in a gradual manner for the purpose of transferring the plush thread stitches. Moreover, the sinkers could be constructed in such a way that a transfer of the main and/or plush thread stitches to another sinker is not necessary. In this connection, the use of a sinker with three edges located one above the other and constructed in a manner corresponding to the edges 15, 16a and 24 would be conceivable in particular. Further, it would also be possible to accommodate the swivelable or tiltable sinkers in the grooves of the needle cylinder 1 in addition. It is also possible to leave the plush thread stitches on the sinkers 4 and 5 during the knocking over corresponding to FIGS. 17 and 18, i.e. not to draw back the sinkers 5, or to provide other means for preventing the transfer of the main and/or plush thread loops from one sinker to the other. It is important only that the edges holding the plush thread loops be gradually transferred from their higher pre-sinking position to a lower knocking-over position during the continued drawing back of the knitting tools 2 following the pre-forming so as to prevent a breaking of the thread during the knocking over of the stitches on the one hand and to keep the stitches under control also during the knocking over on the other hand. The same applies for the sinker edges holding the main thread loops.

Finally, the described construction and control of the sinkers 4, 5 can be advantageously used for the production of both patterned and unpatterned plush goods, since in both cases the plush and main threads are kept under control until the looping. Consequently, for the production of patterned plush goods, it follows that plush thread floats of a determined, critical length can also be provided without the risk that plush thread loops which are already formed beforehand will be shortened again. It is evident, that the methods and machines described above may also be used for producing knitted plush fabrics which not only have stitches being made from ground and plush threads but also stitches being made only from at least a ground thread or at least a plush thread.

While the invention has been illustrated and described as embodied a large diameter circular knitting machine having knitting needles in the cylinder and sinkers in the sinker ring, it is not intended to be limited to the details shown, since various modifications and structural changes may be made without departing in any way from the spirit of the present invention, particularly with respect to other circular and flat knitting machines.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Method for the production of plush goods on a knitting machine having knitting tools with hooks and sinkers assigned to said knitting tools, said plush goods being provided with stitches made from main threads and plush threads by the steps of: feeding main threads and plush threads to the hooks and sinkers; pre-forming at least said plush threads to plush thread loops by drawing back the knitting tools from a plush thread receiving position into an intermediate position and by, in so doing, drawing and holding taut said plush threads over associated ones of said sinkers; and then forming stitches with said main threads and said plush thread loops by drawing back the knitting tools farther into a knocking-over position and by diminishing the risk of shortening or undoing the pre-formed plush thread loops during stitch formation thereby holding the pre-formed plush thread loops taut by control of the sinkers during said stitch formation.

2. Method according to claim 1, further comprising displacing the sinkers as the knitting tools are continued to be drawn back while maintaining taut the pre-formed plush thread loops.

3. Method according to claim 2, wherein the sinkers are displaced by swiveling.

4. Method according to claim 2 or 3, wherein the sinkers are controlled in such a way that the pre-forming of the plush thread loops is effected with first sinker edges and the formation of the stitches containing at least a plush thread is effected with second sinker edges and wherein the plush thread loops are gradually transferred from the first to the second sinker edges at the latest during the continued drawing back of the knitting tools.

5. Method according to claim 1 wherein main thread loops are pre-formed by means of the sinkers and by means of drawing back the knitting tools from a main thread receiving position into the intermediate position, and wherein the main thread loops are transferred form third to fourth sinker edges, at the latest during the continued drawing back of the knitting tools.

6. Method according to claim 5, wherein a sinker with the third and fourth edge is assigned to every knitting tool, wherein the third edge lies higher and is shorter than the fourth edge and wherein the main thread loops are transferred in that the sinkers are drawn back until the main thread loops slide off from the third edges to the fourth edges and then advanced again.

7. Method according to claim 1 wherein a first swivelable sinker and a second sinker is assigned to every knitting tool, wherein the first sinkers comprise first edges and the second sinkers comprise second edges, said first edges normally being above said second edges, and wherein the plush thread loops are transferred from the first sinkers to the second sinkers in that the second sinkers are drawn back, the knitting tools are drawn down, the first sinkers are simultaneously swiveled gradually until the first edges are disposed at substantially the same height as the second edges, the second sinkers are then advanced until the plush thread loops also lie on the second edges and the first sinkers are then drawn back until the plush thread loops are released.

8. Knitting machine for the production of plush knitted goods containing stitches made from main and plush threads comprising: a needle carrier in which knitting tools for the formation of said stitches are movably supported, a sinker carrier in which sinkers for controlling said stitch formation are movably supported, at least one main thread guide for feeding the main thread, at least one plush thread guide for feeding the plush thread, and a cam arrangement for controlling the knitting tools and sinkers, said cam arrangement comprising means for drawing back said knitting tool to an intermediate position and then farther into a knocking over position and for presenting sinkers to hold the pre-formed plush thread loops taught thereby diminishing the risk of shortening or undoing of pre-formed plush thread loops during stitch formation.

9. Knitting machine according to claim 8, wherein the sinkers are swivelably supported in the sinker carrier and comprise edges for pre-forming the plush thread loops, and wherein the means for controlling the sinkers is constructed in such a way that the edges are arranged at a first height during the pre-forming of the loops and can then be swiveled to a second height.

10. Knitting machine according to claim 9, wherein the swiveling of the sinkers is effected under the influence of a tension exerted by the knitting tools on the plush threads.

11. Knitting machine according to claim 10, wherein the means for controlling the sinkers is a cam part for limiting the swiveling process of the sinkers during the drawing back of the knitting tools into the knocking-over position.

12. Knitting machine according to claim 11, wherein the means for controlling the sinkers also contains a cam part for the subsequent swiveling back movement of the sinkers into a pre-forming position.

13. Knitting machine according to claim 9, wherein two sinkers are assigned to every knitting tool, one of which sinkers being the swivelable sinker.

14. Knitting machine according to claim 13, wherein the other sinker is a holding-down and knocking-over sinker.

* * * * *